United States Patent [19]

Smith, Jr. et al.

[11] 4,233,069

[45] Nov. 11, 1980

[54] MODIFIED BRASS ALLOYS WITH IMPROVED STRESS RELAXATION RESISTANCE

[75] Inventors: Warren F. Smith, Jr., Branford; John M. Vitek, Cheshire; Eugene Shapiro, Hamden, all of Conn.

[73] Assignee: Olin Corporation, New Haven, Conn.

[21] Appl. No.: 91,417

[22] Filed: Nov. 5, 1979

Related U.S. Application Data

[63] Continuation-in-part of Ser. No. 919,964, Jun. 28, 1978, abandoned.

[51] Int. Cl.[3] ..... C22C 9/04; C22F 1/08

[52] U.S. Cl. ..... 75/157.5; 75/162; 148/2; 148/11.5 C

[58] Field of Search ..... 75/153, 157.5, 162; 148/2, 11.5 C, 12.7 C, 13.2, 160

[56] References Cited

U.S. PATENT DOCUMENTS

| | | | |
|---|---|---|---|
| 1,938,172 | 12/1933 | Crampton | 75/162 |
| 2,935,400 | 3/1960 | Zeider et al. | 75/157 |
| 3,253,910 | 5/1966 | Burghoff et al. | 75/157.5 |
| 3,982,933 | 9/1976 | Rudolph et al. | 75/154 |

FOREIGN PATENT DOCUMENTS

| | | | |
|---|---|---|---|
| 51-2414 | 1/1976 | Japan | 75/157.5 |
| 575316 | 2/1946 | United Kingdom | 75/157.5 |

OTHER PUBLICATIONS

Genders et al., *The Casting of Brass Ingots*, London: British Non-Ferrous Metals Research Association, 1943, p. 38.

Burke et al., *Grain Control in Industrial Metallurgy*, presented to members of ASM during 30th National Metal Congress and Exposition, Philadelphia, Pa., Oct. 23-29, 1948, pp. 158-208.

*Primary Examiner*—L. Dewayne Rutledge
*Assistant Examiner*—Peter K. Skiff
*Attorney, Agent, or Firm*—Paul Weinstein

[57] ABSTRACT

An alloy system which exhibits improved resistance to stress relaxation at elevated temperatures utilizes additions of magnesium plus aluminum to a copper-zinc base to attain the stress relaxation performance. Processing of this alloy system should be performed so as to maintain at least 90% by weight alpha-phase within the alloy.

15 Claims, No Drawings

MODIFIED BRASS ALLOYS WITH IMPROVED STRESS RELAXATION RESISTANCE

CROSS REFERENCE TO RELATED APPLICATION

This application is a continuation-in-part of copending application Ser. No. 919,964 for "Modified Brass Alloys With Improved Stress Relaxation Resistance", filed June 28, 1978, abandoned.

BACKGROUND OF THE INVENTION

Material used for spring connection devices must exhibit the ability to maintain adequate contact pressure for the design life of any part formed from the material. This ability to maintain adequate contact pressure is the ability to resist stress relaxation over a period of time, especially at temperatures elevated above normal room temperature. The current trend in connector design has been to place greater emphasis upon the maintenance of high contact pressure on connector parts at mildly elevated temperatures to anticipate any problems which might develop in use. Alloys 220 and 260 are currently widely used for electrical connectors but tend to exhibit a rather poor stress relaxation resistance at temperatures of 75° C. or higher. Accordingly, it is important that these widely used alloys be modified in such a manner so as to improve their elevated temperature stress relaxation performance.

It is important to any modifications of Alloys 220 and 260 that the conductivity of these alloys be maintained without any detrimental effect upon improvements in the stress relaxation performance. Furthermore, bend formability should be maintained while any cost increase in the alloys should be held down as low as possible to keep such alloys competitive in the market. Other performance characteristics such as stress corrosion, solderability, softening resistance and others should not be significantly degraded below those properties shown by Commercial Alloys 220 and 260. It is desirable in the present invention that the performance of such alloys exhibit approximately a 25% increase over projected stress remaining after 100,000 hours at 75° C. or higher relative tc Alloys 220 and 260. It is also desirable in the present invention that such alloys maintain approximately a 25% IACS conductivity while keeping any cost increase determined by the metal value plus conversion cost below 10% greater than the cost of Alloy 260.

One alloy system which has been developed in the prior art is an improved beta-brass alloy as shown in U.S. Pat. No. 4,055,445 to Horace Pops. This particular patent teaches a brass alloy which exhibits a shape memory effect and which may contain from 25 to 40% by weight zinc along with 0.25 to 3.0% by weight silicon. It should be noted that the only useful alloy system within this broad range is shown by the cross hatched area in FIG. 3 of said patent, wherein the alloy should have a minimum amount of 25% by weight beta-phase up to 75%. Apparently, not only the particular alloy system itself but its specific processing is important in preparing the improved alloy of this particular patent. It is quite important to this patent that an annealing be performed so as to provide the above-mentioned minimum amount of beta-phase material within the alloy system.

It is a principal object of the present invention to provide an alloy system which exhibits improved stress relaxation resistance, particularly at elevated temperatures, when compared to Commercial Alloys 220 and 260.

It is a further object of the present invention to provide an alloy system as aforesaid which maintains approximate conductivity values found in Alloys 220 and 260 without detrimentally affecting the improved stress relaxation resistance.

It is an additional object of the present invention to provide an alloy system as aforesaid which either consists of an entire alpha-phase or contains at most 10% beta within the alloy matrix.

It is an additional object of the present invention to provide an alloy system as aforesaid which provides the noted benefits without appreciably increasing the cost of such an alloy.

Further objects and advantages will become apparent from a consideration of the following specification.

SUMMARY OF THE INVENTION

The alloy system of the present invention utilizes unique additions of magnesium plus aluminum to an alpha-brass containing 8 to 32.8% by weight zinc to provide improvements in the stress relaxation behavior of such an alloy particularly at large degrees of cold reduction. The alloy system of the present invention meets these objectives without appreciably detrimentally affecting the electrical conductivity of the base copper-zinc alloy system. The elemental additions made to the base alloy also provide these increases in performance without appreciably affecting the processing of the alloy system, which contributes to keeping down the cost of such an alloy.

DETAILED DESCRIPTION

The alloy system of the present invention accomplishes its objectives by adding from 0.05 to 0.5% by weight magnesium in combination with 0.02 to 0.5% by weight aluminum, to an alpha-brass containing 8 to 32.8% by weight zinc. The maximum zinc content should be selected in accordance with the following equation: wt.% zinc$=32.8-4.8\times$wt.% aluminum. This should assure that the alloy is essentially a single-phase alpha alloy even at elevated temperatures approaching the solidus temperature of the alloy.

The preferred compositional ranges for these particular additions should range from 0.1 to 0.5% by weight magnesium and from 0.05 to 0.5% by weight aluminum. The optimal magnesium range for this alloy should be from 0.1 to 0.5% by weight. It should be noted that the total amount of magnesium in the alloy should be limited by the affect of the magnesium upon the processing of the alloy.

The elemental additions discussed above maintain an essentially single-phase alpha alloy. It should be stressed that beta-phase formation should be avoided as much as possible when the magnesium plus aluminum additions are made to the base copper-zinc system. Immediately after casting and solidification of the magnesium plus aluminum alloy a non-equilibrium beta-phase may be present within the system. Further processing of this alloy should try to keep this beta-phase to a maximum of 10 wt. percent. In particular, the alloy system of the present invention is compositionally selected so that it cannot be annealed in an alpha plus beta or a beta-phase region since it remains essentially alpha-phase up to within about 25° C. of its solidus temperature. The presence of the beta-phase adversely affects the cold workability of the alloy as well as its stress corrosion resistance. Various other elements may be added to the alloy of the present invention to suit various purposes. For example, a grain refining element selected from the group consisting of 0.001 to 5.0% by weight iron, 0.001 to 5.0% by weight cobalt, 0.001 to 1.0% by weight chromium, 0.001 to 1.0% by weight zirconium, 0.001 to 1.0% by weight nickel, 0.001 to 1.0% by weight titanium, or any combination thereof may be added to the alloy. Various other elements such as lead may be added to improve the machinability of the alloy and elements such as arsenic may be added to improve the stress corrosion performance of the alloy. Naturally, the alloy of the present invention may also contain impurities common for alloys of this type and additional additives may be employed in the alloy, as desired, in order to emphasize particular characteristics or to obtain particularly desirable results.

It has normally been expected in this art that an increase in yield strength of such an alloy should provide an improvement in the stress relaxation performance of the alloy. The improvements brought about by the alloy system of the present invention are considerably greater than those improvements which can be realized by increasing the yield stress alone. These modifications made in the present invention do raise the yield strength of Alloy 260 brass by as much as 13% while they raise the stress remaining values of the alloy by as much as 30%. It is this unexpected increase in the stress remaining value of the alloy system which provides the surprising benefits of the present invention.

The processing of the alloys of the present invention includes various stages of hot and cold working along with various annealing stages. The hot working of this alloy system should be done at a minimum temperature which is above the recrystallization temperature of the particular alloy being worked and which is below the solidus temperature of the alloy. This temperature will range between 500° and 1000° C. or preferably between 600° and 900° C. An optional step after hot working in the processing can be a diffusion annealing step. This annealing will utilize a temperature range of from 200° to 800° C. for 1 to 24 hours or preferably a range of 400° to 700° C. for 1 to 12 hours. The alloy can then be subjected to a milling step, whether or not it undergoes the annealing step, in order to clean the surface of the worked alloy and prepare it for further working. The alloy may then be cold worked with up to but not including a 100% reduction in area and preferably a 10 to 98% reduction in cross-sectional area. The cold worked material can then be subjected to an annealing step at 150° to 900° C. for enough time to recrystallize the alloy to a grain size of 0.005 to 0.05 mm. This annealing can be accomplished in cycles with cold working steps provided that cold working is the last step of the cycle. Cleaning of the worked material can be performed after any one of the annealing steps and not necessarily after each annealing step.

The present invention will be more readily understood from a consideration of the following illustrative examples.

EXAMPLE I

Alloys of the present invention were all made by adding the elemental additions to molten copper at approximately 1100° C. The zinc was added at approximately 1050° C. and all ingots were poured at 950° C. to 1050° C. These ingots were then soaked at 800° C. for 2 hours prior to hot working by rolling down to a 0.48" gage and then both rolled surfaces were milled to a final gage of 0.4". Subsequent processing consisted of cold working up to a 60% reduction with interanneals of 550° C. for one hour in air between each cold working pass. The material utilized in this processing should be given a final anneal such that the grain size of the alloy should be approximately 0.010 mm.

Various alloys were cast in air as 10 lb. ingots with the compositions in weight percent as shown in Table I. Four control alloys of copper-30% zinc were cast and the average properties of the four controls were utilized at subsequent measurements. A control alloy of copper-10% zinc was also cast. An additional alloy of commercially processed copper-30% zinc brass was also utilized. The appropriate amounts of the required elements were added to molten copper and the melts were poured through a tundish into a chilled mold. The processing of the alloys consisted of soaking at 800° C. for 2 hours followed by hot rolling a 0.48" and surface milling down to 0.4". The alloys were subsequently cold rolled with intermediate annealing. This annealing was utilized to provide a grain size in the alloy prior to a final cold reduction of 0.01 mm. The final cold rolling reductions were either 35% or 60%, which values were selected for property measurement at each point.

Samples were machined from the 0.03" final gage material after cold working and were tested for their stress relaxation behavior in the longitudinal direction at 75° C. Initial loading was set at 80% of each alloy's 0.2% yield stress. Data for percent stress remaining at 1,000 or more hours of testing were extrapolated to 100,000 hours. The logarithm of stress remaining versus the logarithm of time and hours was assumed to be a linear relationship. The results are presented in Table II.

TABLE I

NOMINAL COMPOSITIONS OF ALLOYS

| Alloy No. | Composition % Zn | % Mg | % Al | % Cu |
|---|---|---|---|---|
| Control (30 Zn) | 30 | — | — | Rem. |
| Control (10 Zn) | 10 | — | — | Rem. |
| Commercial Alloy 260 | 30 | — | — | Rem. |
| C227 | 30 | 0.2 | 0.1 | Rem. |
| C252 | 30 | 0.2 | 0.1 | Rem. |
| C154 | 30 | 0.2 | 0.4 | Rem. |
| C229 | 29 | 0.2 | 0.4 | Rem. |

TABLE II

ALLOY PROPERTIES

| Alloy | % CW | 0.2% YS | UTS | % Elong. | MBR (in 1/64")* | Initial Stress | Stress Relaxation Behavior: Actual 1,000 H. % Stress Remaining | Extrapolated 100,000 H. % Stress Remaining | Extrapolated 100,000 H. Stress Remaining |
|---|---|---|---|---|---|---|---|---|---|
| Control | 35 | 71.4 | 79.7 | 7.7 | 4 | 57.1 | 76.8 | 66.9 | 38.2 |
| (30 Zn) | 60 | 86.1 | 99.6 | 2.8 | 16 | 68.9 | 70.4 | 59.4 | 40.9 |
| Commercial Alloy 260 | 60 | 85.8 | 102.0 | 2.5 | N.A. | 68.6 | 68.1 | 56.9 | 39.0 |
| C227 | 35 | 74.2 | 82.0 | 7.3 | 4 | 59.3 | 85.0 | 79.9 | 47.4 |
| | 60 | 87.9 | 99.9 | 2.5 | 16 | 70.3 | 78.1 | 68.2 | 47.9 |
| C252 | 35 | 78.0 | 88.0 | 5.0 | 4 | 62.4 | 83.6 | 77.6 | 48.4 |

TABLE II-continued

| ALLOY PROPERTIES | | | | | | | Stress Relaxation Behavior | | |
|---|---|---|---|---|---|---|---|---|---|
| Alloy | % CW | 0.2% YS | UTS | % Elong. | MBR (in 1/64")* | Initial Stress | Actual 1,000 H. % Stress Remaining | Extrapolated 100,000 H. % Stress Remaining | Extrapolated 100,000 H. Stress Remaining |
| | 60 | 90.1 | 102.7 | 1.5** | 20 | 72.1 | 76.7 | 67.4 | 48.6 |
| C154 | 35 | 82.0 | 93.7 | 4.5 | 10 | 65.6 | 80.4 | 71.8 | 47.1 |
| | 60 | 95.4 | 109.7 | 2.0 | >32 | 76.3 | 73.0 | 60.4 | 46.1 |
| C229 | 35 | 76.8 | 86.2 | 6.0 | 4 | 61.4 | 84.6 | 79.5 | 48.8 |
| | 60 | 90.5 | 103.0 | 2.3 | 20 | 72.4 | 76.3 | 67.5 | 48.9 |
| Control | 35 | 55.9 | 59.2 | 5.0 | N.A. | 43.7 | 65.2 | 50.3 | 22.0 |
| (10 Zn) | 60 | 68.4 | 72.4 | 2.5 | N.A | 52.2 | 66.4 | 54.6 | 28.5 |

*In Transverse direction;
**Broke outside gage marks;
N.A. - Not Available;
YS, UTS, Initial Stress and Stress Remaining values are all in ksi.

As can be seen from Table II, the alloys according to the present invention exhibit surprising stress relaxation resistance behavior when compared to either Commercial Alloy 260 or a similar laboratory manufactured material. The Stress Remaining portion of Table II extrapolated to 100,000 hours indicates that the benefits derived from the present invention are more than can be expected from a simple increase in yield strength compared to the base alloys. For example, while the yield strength of Alloy C227 the composition of which falls within the present invention, is only 2.8 ksi and 1.8 ksi at 35% cold worked and 60% cold worked greater than the 30 Zn Control Alloy, the stress remaining at 100,000 hours is 9.2 and 7 ksi greater at these cold working reductions than the Control Alloy. This clearly demonstrates the unexpected and surprising improvement in stress relaxation resistance brought about by the alloys of the present invention.

EXAMPLE II

The alloys listed in Table I were processed described in Example I and the stress remaining after 100,000 hours was determined based on initial stress levels of 60 and 70 ksi corresponding to hard temper brass and spring temper brass, respectively. The percentage difference over the average Cu-30% Zn base alloy was also measured. The results are shown in Table III.

Electrical conductivities for each of these alloys were measured in various degrees of worked and annealed conditions. These results are shown in Table IV.

TABLE IV

| CONDUCTIVITY PROPERTIES* | | |
|---|---|---|
| Alloy No. | Condition | Conductivity (% IACS) |
| Control (30 Zr) | 35% CW | 26.1 |
| C227 | Annealed | 27.0 |
| C252 | Annealed | 26.5 |
| C154 | 35% CW | 23.1 |
| C229 | Annealed | 26.0 |

*Values for conductivity in the cold worked condition are 1.5 to 2.5% IACS lower than the annealed values.

The results shown in Table III demonstrate the significant improvement in stress relaxation resistance exhibited by the alloys of the present invention at both levels of initial stress when compared to the average of the copper-30 zinc controls. It is believed that the benefits derived from the present invention are concentration dependent in that the greater the amounts of magnesium in the alloy, the higher the percentage difference over the control alloy.

As can be seen from Table IV, the conductivity values for the alloys of the present invention compare quite favorably with the conductivity of the control material. It is believed that the same concentration dependency which influences the stress relaxation resistance tends to somewhat reduce the conductivity of the alloys. Therefore, it becomes necessary for a user of the alloy system of the present invention to determine a trade off point between desired high stress relaxation resistance and desired maintenance of electrical conductivity.

This invention may be embodied in other forms or carried out in other ways without departing from the spirit or essential characteristics thereof. The present

TABLE III

STRESS REMAINING AFTER 100,000 HOURS AND IMPROVEMENT OVER BRASS CONTROLS BASED ON INITIAL STRESS LEVELS OF 60 and 70 KSI

| | | 60 ksi Initial Stress | | | 70 ksi Initial Stress | | |
|---|---|---|---|---|---|---|---|
| Alloy No. | Nominal Composition | % SR | 100,000 H. SR | % Difference Over Average Cu-30 Zn | % SR | 100,000 H SR | % Difference Over Average Cu-30 Zn |
| Average of Cu-30 Zn Controls | Cu-30 Zn | 65.4 | 39.2 | — | 60.0 | 42.0 | — |
| C227 | Cu-30 Zn-0.2 Mg-0.1 Al | 79.2 | 47.5 | +21 | 68.5 | 48.0 | +14 |
| C252 | Cu-30 Zn-O.2 Mg-0.1 Al | 80.1 | 48.1 | +23 | 69.6 | 48.7 | +16 |
| C154 | Cu-30 Zn-0.2 Mg-0.4 Al | 77.8 | 46.7 | +19 | 67.1 | 47.0 | +12 |
| C229 | Cu-29 Zn-0.2 Mg-0.4 Al | 81.0 | 48.6 | +24 | 70.1 | 49.1 | +17 |

embodiment is therefore to be considered as in all respects illustrative and not restrictive, the scope of the invention being indicated by the appended claims, and all changes which come within the meaning and range of equivalency are intended to be embraced therein.

What is claimed is:

1. An essentially single-phase alpha alloy which is particularly resistant to stress relaxation at elevated temperatures, said alloy consisting essentially of from 0.05 to 0.5% by weight magnesium, from 0.02 to 0.5% by weight aluminum, from 8 to 32.8% by weight zinc, balance copper, with the maximum wt.% zinc=32.8−4.8×wt.% aluminum.

2. An alloy according to claim 1 wherein said magnesium is from 0.1 to 0.5% by weight and said aluminum is from 0.05 to 0.5% by weight.

3. An alloy according to claim 2 wherein the amount of said magnesium in the alloy is 0.1 to 0.2% by weight.

4. An alloy according to claim 1 wherein said alpha-phase within the alloy accounts for at least 90% by weight of the alloy.

5. An alloy according to claim 1 wherein said alloy is in the worked condition and has a grain size of approximately 0.005 to 0.050 mm.

6. An alloy according to claim 1 which is essentially a single-phase alpha alloy at elevated temperatures approaching the solidus temperature of said alloy.

7. A method for producing an essentially single-phase alpha alloy which is particularly resistant to stress relaxation at elevated temperatures, said method comprising the steps of:

(a) casting an alloy consisting essentially of from 0.05 to 0.5% by weight magnesium, from 0.02 to 0.5% by weight aluminum, from 8 to 32.8% by weight zinc, balance copper, with the maximum wt.% zinc=32.8−4.8×wt.% aluminum;

(b) hot working said alloy at a temperature above the recrystallization temperature of the alloy and below the solidus temperature of the alloy;

(c) cold working said alloy with up to but not including a 100% reduction in area; and (d) annealing the worked alloy at 150° to 900° C. to recrystallize the alloy to a grain size of 0.005 to 0.050 mm.

8. A method according to claim 7 wherein said cold working is accomplished in cycles with said annealing provided that a cold working step is the last step of the cycle.

9. A method according to claim 7 wherein said beta-phase in the alloy is kept to a maximum of 10% by weight throughout the processing of the alloy.

10. A method according to claim 7 wherein said alloy is annealed at 200° to 800° C. for 1 to 24 hours after said hot working but before said cold working.

11. A method according to claim 7 wherein said hot working is at 500° to 1000° C.

12. A method according to claim 7 wherein said cold working utilizes a 10 to 98% reduction in cross-sectional area of said alloy.

13. A method according to claim 7 wherein the surface of said alloy is milled or cleaned after said hot working but before said cold working.

14. A method according to claim 7 wherein said magnesium is from 0.1 to 0.5% by weight and said aluminum is from 0.1 to 0.5% by weight aluminum.

15. An alloy according to claim 14 wherein the amount of said magnesium in the alloy is from 0.1 to 0.2% by weight.

* * * * *